United States Patent [19]

Dalichow

[11] 4,377,035

[45] Mar. 22, 1983

[54] CULTRY PLACE SETTING

[75] Inventor: Ernst-Wilhelm F. Dalichow, Solingen, Fed. Rep. of Germany

[73] Assignee: Heinr. Boker GmbH & Co. Baumwerk, Solingen, Fed. Rep. of Germany

[21] Appl. No.: 242,927

[22] Filed: Mar. 12, 1981

[30] Foreign Application Priority Data

Mar. 27, 1980 [DE] Fed. Rep. of Germany ..... 3011772

[51] Int. Cl.[3] ..... A47G 21/06

[52] U.S. Cl. ..... 30/147

[58] Field of Search ..... 30/142, 147, 125, 148, 30/149; 7/112, 113

[56] References Cited

U.S. PATENT DOCUMENTS

| | | | |
|---|---|---|---|
| 34,098 | 1/1862 | Hardie | 30/147 |
| 1,030,756 | 6/1912 | Yakligian | 30/148 X |
| 1,317,691 | 10/1919 | Fields | 30/125 |
| 2,109,016 | 2/1938 | Ringer | 30/148 X |
| 3,389,412 | 6/1968 | Emmons | 30/147 X |
| 4,317,284 | 3/1982 | Prindle | 30/147 X |

FOREIGN PATENT DOCUMENTS

| | | | |
|---|---|---|---|
| 713303 | 11/1941 | Fed. Rep. of Germany | 30/147 |
| 579949 | 8/1946 | United Kingdom | 30/147 |

*Primary Examiner*—Jimmy C. Peters

*Attorney, Agent, or Firm*—Auslander & Thomas

[57] ABSTRACT

A cutlery place setting comprises a knife, a fork, a spoon, and a holder in which the upper ends of the knife, fork and spoon are housed together detachably and which holds them together.

8 Claims, 5 Drawing Figures

CULTRY PLACE SETTING

FIELD OF THE INVENTION

This invention relates to a cutlery place setting, consisting of a knife, fork and a spoon which are to be joined together detachably in an efficient arrangement.

BACKGROUND OF THE INVENTION

Cutlery place settings of this type are known for leisure-time purposes, such as for picnics, camping and the like, in which the knife, fork and spoon which are made entirely of metal are joined together detachably via a headed pin which is secured in the handle of the spoon and may penetrate through longitudinal slits in the handles of the fork and knife. The slits each have at one end an enlarged opening for the head of the pin to pass through. In order to join the knife, fork and spoon of this known leisure-time cutlery place setting, the knife and the fork have to be attached to the headed pin which is permanently secured to the spoon and are then moved into the clamping position which they may occupy when all three components are in an exactly aligned position. This alignment has to be effected by eye. In addition, the pin which is always present on the spoon is unattractive and may also lead to injuries, and dirt may accumulate in the slots of the knife and fork. In this design, the knife, fork and spoon have to be made of metal in order to withstand the strains caused by the pin joint, i.e. they cannot be produced from a plastic material which can be attractively moulded and is easy to clean. All the components are always exposed so that they have to be cleaned before use as well as afterwards.

SUMMARY OF THE INVENTION

The object of this invention is to provide a cutlery place setting which is suitable in particular for picnic purposes, whose individual components may be easily joined together securely or easily detached from each other, and which is attractive in appearance.

According to the invention there is provided a cutlery place setting comprising a knife, a fork, a spoon, and a holder in which the upper ends of the knife, fork and spoon are housed together detachably and which holds them together. In contrast to the known cutlery place settings for camping purposes, the setting components of the cutlery place setting according to the invention are therefore not joined together by connecting elements which penetrate them, but instead their upper ends are inserted into a holder which holds the inserted components together and simultaneously provides a protective cover for the part of the fork and spoon which are to enter the mouth and for the blade of the knife. The holder and the handles of the place setting may be produced from a plastic material which is easy to keep clean and may be moulded in an attractive manner. The place setting may therefore be inexpensively produced, and can be attractive in appearance. Furthermore, the upper ends of the components of the place setting are protected from dirt until they are used. The holder forms a sheath for the blade of the knife, so that the knife may have a sharp cutting edge and a point without giving rise to any risk of injury if the assembled cutlery place setting is handled carelessly. Moreover, the setting components may be easily packed up without having to be cleaned after use, becauses pieces of food which may still be clinging thereto are covered by the holder and therefore cannot cause offence.

In a preferred practical embodiment of the invention, the handles of the setting components are designed so that they fit together and have an externally projecting shoulder on an enlargement thereof which serves as a stop for the holder, the holder being attached onto the enlargements with a snap fitting. In order to insert the setting components into the holder, they merely need to be positioned together so that their enlargements may be inserted as one unit into the holder until the end of the holder meets the shoulder. In order to remove the components, their handles are grasped with one hand and the holder is grasped with the other hand and they are pulled apart. No disturbing parts, projections, recesses, pegs, pins or the like are present on the components of the place setting or on the holder to act as connecting elements. The handles of the components and the holder may be produced from plastics material so that the cutlery place setting may have an attractive appearance and be easy to keep clean.

The handles of the components are appropriately so moulded that the knife and fork accommodate the spoon between them and substantially completely surround the handle of the spoon when the components are assembled. When it is assembled, the cutlery place setting according to the invention appears as a uniform object with no projecting parts which would tend to attract grime or which create the risk of injury.

The holder may also contain a receptacle for salt or similar provisions and may be provided with a detachable covering.

BRIEF DESCRIPTION OF THE DRAWINGS

An embodiment of the cutlery place setting according to the invention is illustrated in the drawings.

DETAILED DESCRIPTION OF PREFERRED EMBODIMENT

Figure 1:
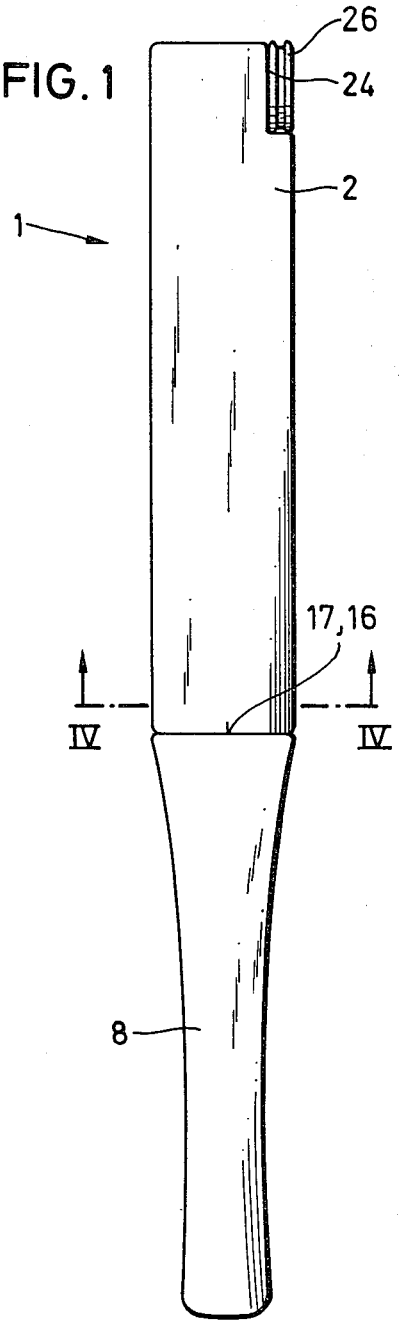
FIG. 1 is a full view of the assembled cutlery place setting.

The cutlery place setting 1 illustrated in the drawings consists of a holder 2 which is approximately rectangular in cross section and place setting components which are inserted detachably therein, namely a knife 3, a smaller spoon 4 and a fork 5. The spoon 4 is moulded in one piece from a plastic material. The knife 3 has a handle 6 moulded from plastic material and a metal blade 7 introduced into the handle. The fork has a handle 8 which is made of plastic material and a metal fork part 9 which is introduced into the handle 8.

Figure 4:
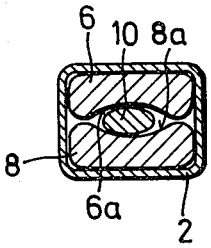
FIG. 4 is a cross section through the assembled cutlery place setting along the line IV—IV in FIG. 1.
Figure 5:
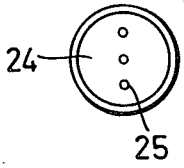
FIG. 5 is a front view of the cover sealing a blind hole in the outer end of the holder.

The handles 6 and 8 are moulded such that they have recesses *6a* and *8a* respectively on their surfaces so that they substantially completely surround the shaft or handle 10 of the spoon 4, as shown in FIG. 4, when the components 3,4 and 5 are correctly assembled and are inserted into the holder 2.

Figure 2:
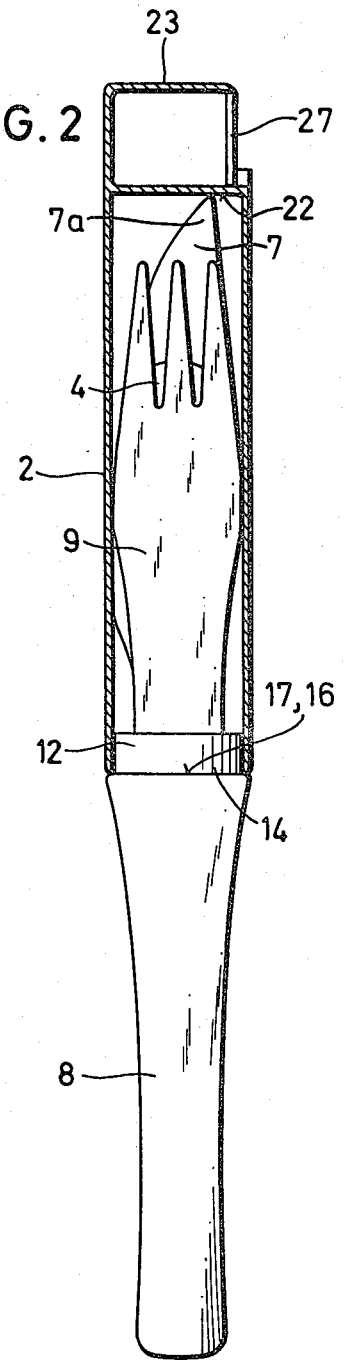
FIG. 2 is a longitudinal section through the holder of the assembled cutlery place setting.
Figure 3:
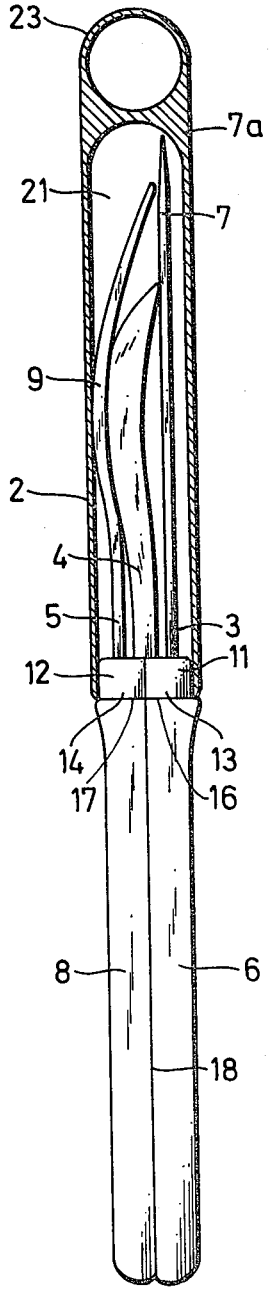
FIG. 3 is a longitudinal section similar to that in FIG. 2, but displaced by 90°.

The handle 6 of the knife 3 and the handle 8 of the fork 5 have enlargements 11 and 12 respectively at the top. Encircling grooves 13 and 14 respectively extend over the back and over both sides of the relevant handle but not at the front of the handle to form the transition to projecting shoulders 16 and 17 which together serve as a stop for restricting the depth of insertion into the holder, as shown particularly by FIGS. 2 and 3. These enlargements 11 and 12 are received into the open end of the holder 2 with a snap fitting or by a clamping seat so that the holder cannot be unintentionally detached.

The holder 2 is rectangular in cross section with rounded corners, as illustrated in particular in FIG. 4. The elastic characteristics of the plastics material from which the holder 2 is made, ensure that it always exerts sufficient pressure on the enlargements 11 and 12 to hold the inserted components 3,4 and 5 together and to prevent the components from slipping out of the holder 2.

The holder 2 has a relatively thin wall and contains a blind hole 21 with a rounded-off end 22 for accommodating the external point *7a* of the blade 7.

A hollow, cylindrical chamber 23 is located at the closed end of the holder 2 and it may be sealed by a covering disc 24. The chamber 23 is suitable for receiving accessories or for use as a salt cellar. In the latter case, the covering disc 24 contains holes 25 which are suitable for sprinkling salt and which may be sealed by a detachable cover 26. The covering disc is detachably held in the opening 27 of the chamber 23 by a clamping seat or a snap fitting.

I claim:

1. A cutlery place setting comprising a knife, said knife including a handle portion, a fork, said fork including a handle portion, a spoon, said spoon including a handle portion, a holder, and said knife, fork and spoon detachably housed together held by said holder, said handle portions adapted to extend outward of said holder.

2. The invention of claim 1 wherein said handles interfit, said handles adapted to detachably engage an end of said holder, said knife, fork and spoon engaged against unintentional detachment.

3. The invention of claim 2 wherein said handles of said knife and fork each include a shoulder, said shoulder acting as a stop with regard to said holder.

4. The invention of claim 1 wherein the knife and fork each have a handle provided with a trough-shaped recess, and the spoon handle is adapted to be received within said recess.

5. The invention of claim 1 wherein said knife and fork handles are molded from a plastic material and include portions of said knife and fork introduced into said handle plastic.

6. The invention of claim 1 wherein said holder is molded from a plastic material, said holder including a recess adapted to receive said fork and knife portions extending from said handles of said fork and knife.

7. The invention of claim 1 wherein said holder includes a chamber at a closed end thereof, said chamber including a detachable closure.

8. The invention of claim 7 wherein said closure includes at least one sprinkle opening, said closure including a detachbale cover.

* * * * *